US010787724B2

(12) United States Patent
Kang et al.

(10) Patent No.: US 10,787,724 B2
(45) Date of Patent: Sep. 29, 2020

(54) ALUMINUM ALLOY FOR INSERT RING, ALUMINUM INSERT RING USING THE SAME, AND PISTON MANUFACTURING METHOD USING THE SAME

(71) Applicants: Hyundai Motor Company, Seoul (KR); Kia Motors Corporation, Seoul (KR)

(72) Inventors: Hee-Sam Kang, Seoul (KR); Eun-Ji Hong, Seoul (KR)

(73) Assignees: Hyundai Motor Company, Seoul (KR); Kia Motors Corporation, Seoul (KR)

( * ) Notice: Subject to any disclaimer, the term of this patent is extended or adjusted under 35 U.S.C. 154(b) by 141 days.

(21) Appl. No.: 15/821,219

(22) Filed: Nov. 22, 2017

(65) Prior Publication Data

US 2018/0171441 A1 Jun. 21, 2018

(30) Foreign Application Priority Data

Dec. 15, 2016 (KR) ..... 10-2016-0171298

(51) Int. Cl.

| | |
|---|---|
| ***B21K 1/18*** | (2006.01) |
| ***C22C 21/14*** | (2006.01) |
| ***B22D 17/00*** | (2006.01) |
| ***C22F 1/00*** | (2006.01) |
| ***C22F 1/057*** | (2006.01) |

(52) U.S. Cl.

CPC ..... *C22C 21/14* (2013.01); *B21K 1/18* (2013.01); *B22D 17/00* (2013.01); *C22F 1/002* (2013.01); *C22F 1/057* (2013.01); *Y10T 428/12764* (2015.01)

(58) Field of Classification Search

None

See application file for complete search history.

(56) References Cited

U.S. PATENT DOCUMENTS

| | | | | |
|---|---|---|---|---|
| 5,430,938 | A * | 7/1995 | Rao | F16J 9/16 29/888.044 |
| 2006/0118076 | A1 | 6/2006 | Schnaitmann | |
| 2015/0167136 | A1 | 6/2015 | Kang et al. | |
| 2016/0289802 | A1 | 10/2016 | Bezencon et al. | |

FOREIGN PATENT DOCUMENTS

| | | | |
|---|---|---|---|
| JP | 2005029847 | * | 2/2005 |
| JP | 2005029847 | A | 2/2005 |
| JP | 2015501877 | A | 1/2015 |
| KR | 20060035615 | A | 4/2006 |
| KR | 20120088374 | A | 8/2012 |
| KR | 20140109912 | A | 9/2014 |
| KR | 20150071590 | A | 6/2015 |
| KR | 20150127887 | A | 11/2015 |
| KR | 20160008707 | A | 1/2016 |
| KR | 20170007404 | A | 1/2017 |

* cited by examiner

*Primary Examiner* — Daniel J. Schleis

(74) *Attorney, Agent, or Firm* — Slater Matsil, LLP

(57) ABSTRACT

Disclosed herein are an aluminum alloy for an insert ring, an aluminum insert ring using the same, and a piston manufacturing method using the same, and, particularly, are an insert ring manufactured to have high strength and abrasion resistance and reduce its weight by adjusting aluminum alloy components, and a method of manufacturing a piston having high bonding properties to the insert ring through the same.

14 Claims, 9 Drawing Sheets

GENERATION OF PROEUTECTIC $Al_2Cu$

ALUMINUM ALLOY FOR INSERT RING, ALUMINUM INSERT RING USING THE SAME, AND PISTON MANUFACTURING METHOD USING THE SAME

CROSS-REFERENCE TO RELATED APPLICATIONS

This application claims priority to Korean Patent Application No. 10-2016-0171298, filed on Dec. 15, 2016, which is incorporated herein by reference in its entirety.

TECHNICAL FIELD

Exemplary embodiments of the present invention relate to an aluminum alloy for an insert ring, an aluminum insert ring using the same, and a piston manufacturing method using the same.

BACKGROUND

In typical gasoline engines, combustion is performed in such a way to ignite a uniform fuel-air mixture with a spark plug before the initiation of the combustion. Whereas in typical diesel engines auto-ignition combustion is performed in such a manner that only air is introduced into and compressed at a high compression ratio in a chamber, and then fuel is injected at high pressure into the chamber. Particularly, a method, in which fuel injected by an injector is swirled in a bowl that is formed in a piston such that the fuel is well mixed with air, is mainly used for combustion in most diesel engines.

A cast iron-based insert ring, which is referred to as a Ni-resist carrier having an advantage in terms of functions and costs, is inserted into a piston in order to reinforce a top land portion.

As illustrated in FIG. 1, an insert ring is first inserted into a mold after a surface treatment process such as an AlFin process is performed in order to improve bonding properties between the insert ring and aluminum as a base material of a piston.

The piston is manufactured in such a way to insert the insert ring in the mold before the casting of the piston, and then to fill the mold with molten aluminum. Since the piston is manufactured by such a process, it is very difficult to secure a casting quality of the piston, besides an increase in cost.

In addition, it is impossible to apply the insert ring to a piston that is forged to reduce its weight and improve its durability, unlike the cast piston.

In addition, since a piston body and an insert ring are made of aluminum alloy and cast iron, respectively, which are different materials, they have low bonding properties due to poor bonding and a difference in coefficient of thermal expansion between dissimilar metals. For this reason, the interfaces between the piston body and the insert ring may be separated from each other when they are used for a long time in an engine that is subjected to severe thermal fatigue.

Patent Document Korean Patent No. 10-1119174 (Jan. 26, 2012) discloses subject matter that is related to subject matter disclosed herein.

SUMMARY

Exemplary embodiments of the present invention relate to an aluminum alloy for an insert ring, an aluminum insert ring using the same, and a piston manufacturing method using the same. Particular examples relate to an insert ring manufactured to have high strength and abrasion resistance and reduce its weight by adjusting aluminum alloy components, and a method of manufacturing a piston having high bonding properties to the insert ring through the same.

An embodiment of the present invention is directed to a lightweight Al—Cu—Si-based aluminum alloy having high strength and abrasion resistance, and an insert ring using the same.

Another embodiment of the present invention is directed to a piston manufacturing method capable of improving bonding properties of interfaces between an insert ring and aluminum as a base material of a piston by applying the insert ring thereto.

Other objects and advantages of the present invention can be understood by the following description, and become apparent with reference to the embodiments of the present invention. Also, it is obvious to those skilled in the art to which the present invention pertains that the objects and advantages of the present invention can be realized by the means as claimed and combinations thereof.

In accordance with an embodiment of the present invention, an aluminum alloy for an insert ring is composed of Al as a base material, 24 to 30 wt % of Cu, and 0.3 to 4.1 wt % of Si.

The aluminum alloy may include a lamellar microstructure comprising Al and $Al_2Cu$ on its structure.

The aluminum alloy may have a microstructure including a Si phase on its structure.

The aluminum alloy may include a lamellar microstructure comprising Al and $Al_2Cu$ and a Si phase together on its structure.

In order to generate the lamellar microstructure on the aluminum alloy, a ratio between a phase fraction of Al and a phase fraction of $Al_2Cu$ may be from 0.78 to 1.23.

In accordance with another embodiment of the present invention, an insert ring for an engine piston is manufactured through a casting process using an aluminum alloy that is composed of Al as a base material, 24 to 30 wt % of Cu, and 0.3 to 4.1 wt % of Si and in which a ratio between a phase fraction of Al and a phase fraction of $Al_2Cu$ on its structure is from 0.78 to 1.23.

The insert ring may be formed by coupling two or more separated ring pieces to each other.

In accordance with another embodiment of the present invention, a method of manufacturing an engine piston into which an insert ring is inserted in order to reinforce a top land portion, includes forming a piston body, forming a groove for insertion of an insert ring along an outer circumference of the piston body, inserting each of two or more ring pieces into the groove such that the insert ring is formed by coupling the ring pieces to each other, and re-melting the groove into which each of the ring pieces is inserted.

Each of the ring pieces may be manufactured through a casting process using an aluminum alloy that is composed of Al as a base material, 24 to 30 wt % of Cu, and 0.3 to 4.1 wt % of Si and in which a ratio between a phase fraction of Al and a phase fraction of $Al_2Cu$ on its structure is from 0.78 to 1.23.

The forming a piston body may be performed through a casting or forging process.

In accordance with another embodiment of the present invention, an engine piston is the engine piston manufactured by the above method.

DETAILED DESCRIPTION OF ILLUSTRATIVE EMBODIMENTS

Figure 1:
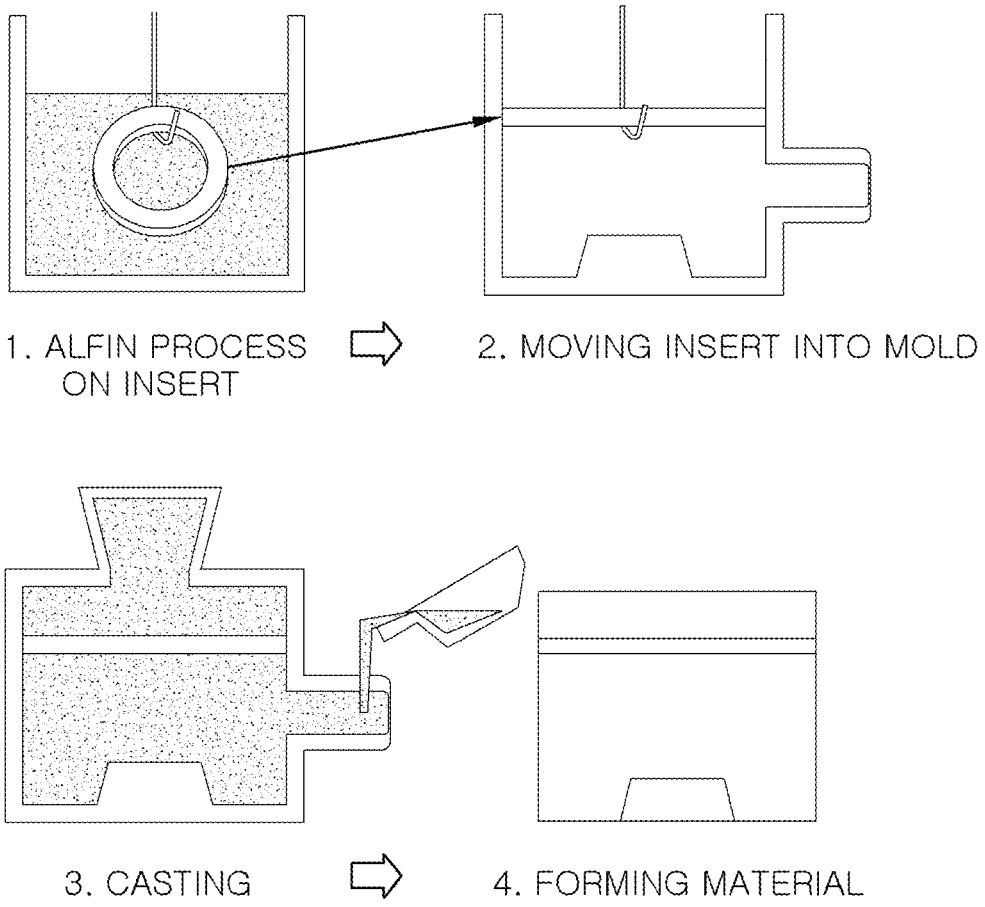
FIG. 1 is a view schematically illustrating a method of manufacturing an engine piston according to the related art.

The terms and words used in the specification and claims should not be construed as their ordinary or dictionary sense. On the basis of the principle that the inventor can define the appropriate concept of a term in order to describe his/her own invention in the best way, it should be construed as meaning and concepts for complying with the technical idea of the present invention. Accordingly, the exemplary embodiments described in the present specification and the construction shown in the drawings are nothing but one preferred embodiment of the present invention, and it does not cover all the technical ideas of the invention. Thus, it should be understood that various changes and modifications may be made at the time of filing the present application. In addition, detailed descriptions of functions and constructions well known in the art may be omitted to avoid unnecessarily obscuring the gist of the present invention. Exemplary embodiments of the present invention will be described below in more detail with reference to the accompanying drawings.

The present invention relates to a lightweight Al—Cu—Si-based aluminum alloy having high strength and abrasion resistance. The aluminum alloy may be used to manufacture an insert ring that is applied to reinforce a top land portion of an engine piston.

Specifically, an aluminum alloy for an insert ring according to an embodiment of the present invention is composed of Al as a base material, 24 to 30 wt % of Cu, and 0.3 to 4.1 wt % of Si, and may include a lamellar microstructure that comprises an Al phase as a reinforcement phase and a phase of $Al_2Cu$ which is an intermetallic compound, and a Si phase.

Hereinafter, the addition and content of each element will be described in detail.

The following Table 1 is a comparison table that shows whether or not the lamellar microstructure is generated depending on the content of Cu (wt % in a manner hereinafter set forth), in which case the content of Si is 1.2 wt % and the rest means a content of Al.

First, Cu is an element of a dispersion-strengthened aluminum alloy in the present invention, and is an element that contributes to the formation of $Al_2Cu$, which is an intermetallic compound, by reaction with Al, thereby contributing to an improvement in strength of material.

Figure 3A:
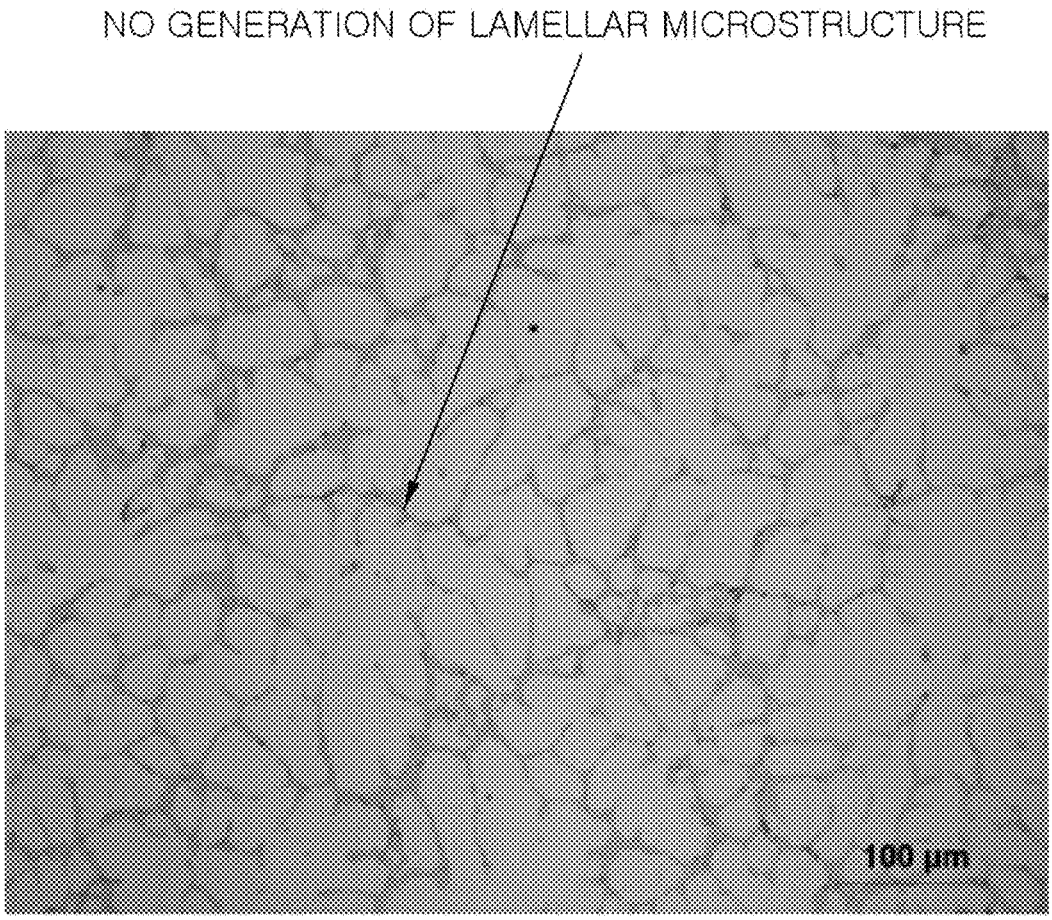
FIG. 3, which includes FIGS. 3A-3C, provide structure photographs illustrating whether or not a lamellar microstructure is generated according to the content of Cu.
Figure 3B:
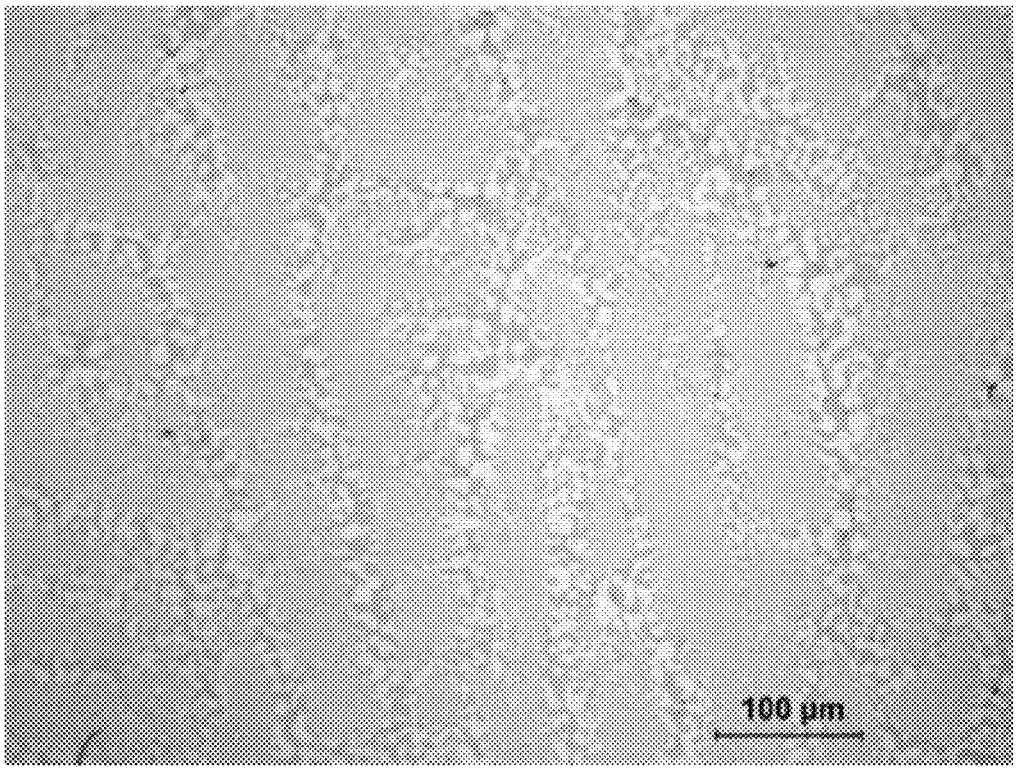

Referring to Table 1, it is necessary to limit a phase ratio of Al to $Al_2Cu$ to from 0.78 to 1.23 in order to generate the lamellar microstructure. As seen in the photograph of FIG. 3A, when the content of Cu is less than 24 wt % and is from 22 to 23 wt %, a small amount of $Al_2Cu$ is formed so that the phase ratio of Al to $Al_2Cu$ exceeds 1.23 and is from 1.33 to 1.45. Hence, the lamellar microstructure is not generated.

Figure 3C:
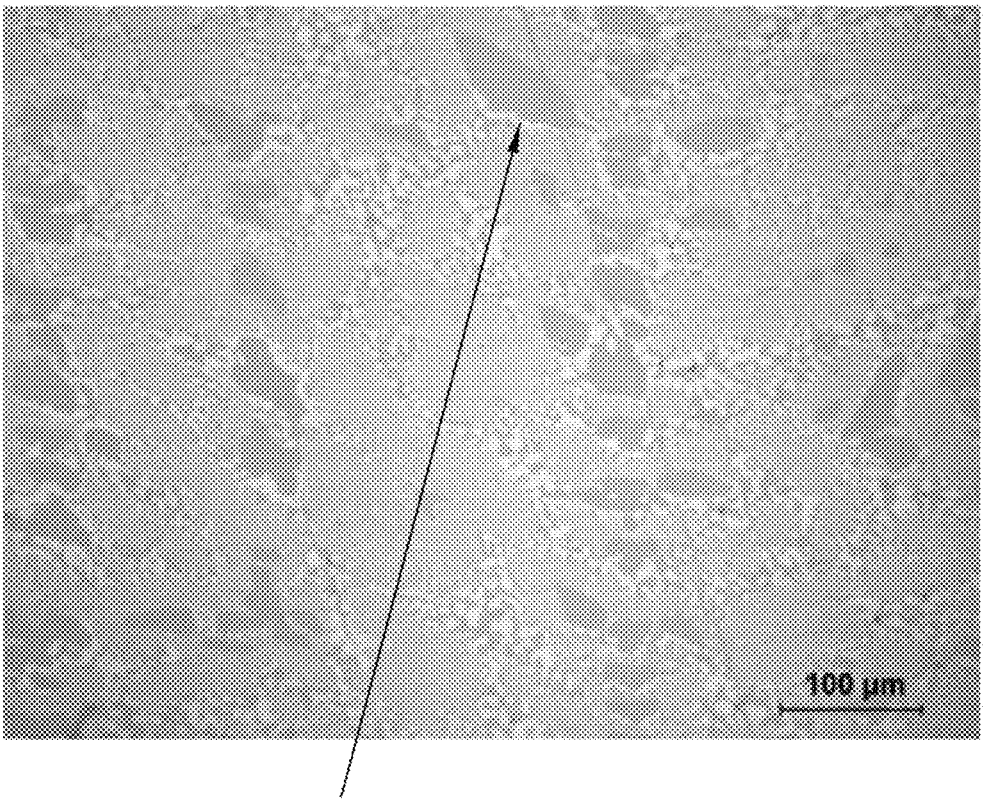

In addition, as seen in the photograph of FIG. 3C, when the content of Cu exceeds 30 wt % and is 31 wt %, an excessive amount of $Al_2Cu$ is formed so that the phase ratio of Al to $Al_2Cu$ is less than 0.78. Hence, proeutectic $Al_2Cu$ is generated to thereby cause brittleness.

Accordingly, in the aluminum alloy for an insert ring according to the embodiment of the present invention, the content of Cu is preferably from 24 to 30 wt %.

TABLE 1

| Sort | Cu Content (wt %) | Si Content (wt %) | Al Phase Fraction (%) | $Al_2Cu$ Phase Fraction (%) | Ratio of Al to $Al_2Cu$ |
|---|---|---|---|---|---|
| Comparative Example | 22 | 1.2 | 58.1 | 40.1 | 1.45 |
| Comparative Example | 23 | 1.2 | 56.2 | 42.1 | 1.33 |
| Present Example | 24 | 1.2 | 54.4 | 44.2 | 1.23 |
| | 26 | 1.2 | 52.5 | 46.3 | 1.14 |
| | 26 | 1.2 | 50.7 | 48.1 | 1.05 |
| | 27 | 1.2 | 48.8 | 50.0 | 0.98 |
| | 28 | 1.2 | 47.0 | 51.8 | 0.91 |
| | 29 | 1.2 | 45.1 | 53.8 | 0.84 |
| | 30 | 1.2 | 43.3 | 55.8 | 0.78 |
| Comparative Example | 31 | 1.2 | 41.4 | 57.8 | 0.72 |

In addition, the aluminum alloy has improved castability, and high strength and abrasion resistance as Si is added thereto.

The following Table 2 is a comparison table that shows tensile strength according to whether or not a Si phase is generated on a microstructure depending on the content of Si, in the case of 28 to 29 wt % of Cu and a balance of Al.

When the content of Si is less than 0.3 wt % and is from 0.1 to 0.2 wt %, no Si phase is generated so that the aluminum alloy has very low strength of 39 MPa due to no dispersion strength. On the other hand, when the content of Si is equal to or more than 4.2 wt %, i.e., is from 4.2 to 4.4 wt %, proeutectic $Al_2Cu$ is generated so that the aluminum alloy has low strength of 180 to 190 MPa due to brittleness. Therefore, the content of Si is preferably from 0.3 to 4.1 wt % in the embodiment of the present invention.

Figure 4:
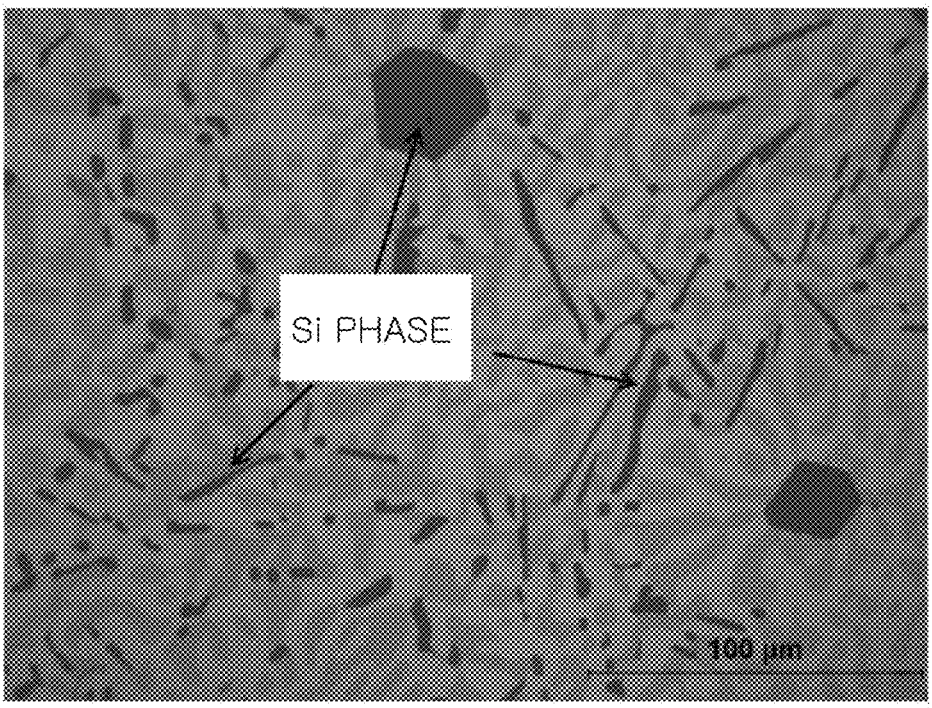
FIG. 4 is a structure photograph of an aluminum alloy according to an embodiment of the present invention.

FIG. 4 is a structure photograph of the aluminum alloy according to the embodiment of the present invention, and it can be seen that the aluminum alloy has very high strength of 201 to 450 MPa owing to generation of Si phases when the content of Si is from 0.3 to 4.1 wt % in the case of 28 to 29 wt % of Cu and a balance of Al.

TABLE 2

| Sort | Cu Content (wt %) | Si Content (wt %) | Strength (MPa) |
|---|---|---|---|
| Comparative Example | 28 | 0.1 | 39 |
| Comparative Example | 28 | 0.2 | 39 |
| Present Example | 28 | 0.3 | 450 |
| | 28 | 1.2 | 430 |
| | 28 | 2.1 | 380 |

TABLE 2-continued

| Sort | Cu Content (wt %) | Si Content (wt %) | Strength (MPa) |
|---|---|---|---|
| | 28 | 3.3 | 288 |
| | 28 | 3.9 | 223 |
| | 29 | 4.0 | 211 |
| | 29 | 4.1 | 201 |
| Comparative Example | 28 | 4.2 | 191 |
| Comparative Example | 28 | 4.4 | 180 |

According to the embodiment of the present invention, it is possible to manufacture a lightweight insert ring for an engine piston, having high strength and abrasion resistance, through a casting process (particularly, die casting) and a heat treatment process using the aluminum alloy that is composed of Al as a base material, 24 to 30 wt % of Cu, and 0.3 to 4.1 wt % of Si and in which the ratio between a phase fraction of Al and a phase fraction of $Al_2Cu$ on the structure thereof is from 0.78 to 1.23. Although the above-mentioned microstructure may be obtained from an as-cast state, the present invention may perform heat treatment for removal of residual stress and optimization of physical properties. In this case, the lightweight insert ring having high strength may be manufactured in the heat treatment process by performing solution treatment at a temperature of 450° C. to 480° C. for 8 hours or more and then performing quenching at a water temperature of 60° C. or more to prevent cracks, and by performing aging treatment at a temperature of 180° C. to 220° C. for 4 to 8 hours to remove residual stress.

Figure 5:
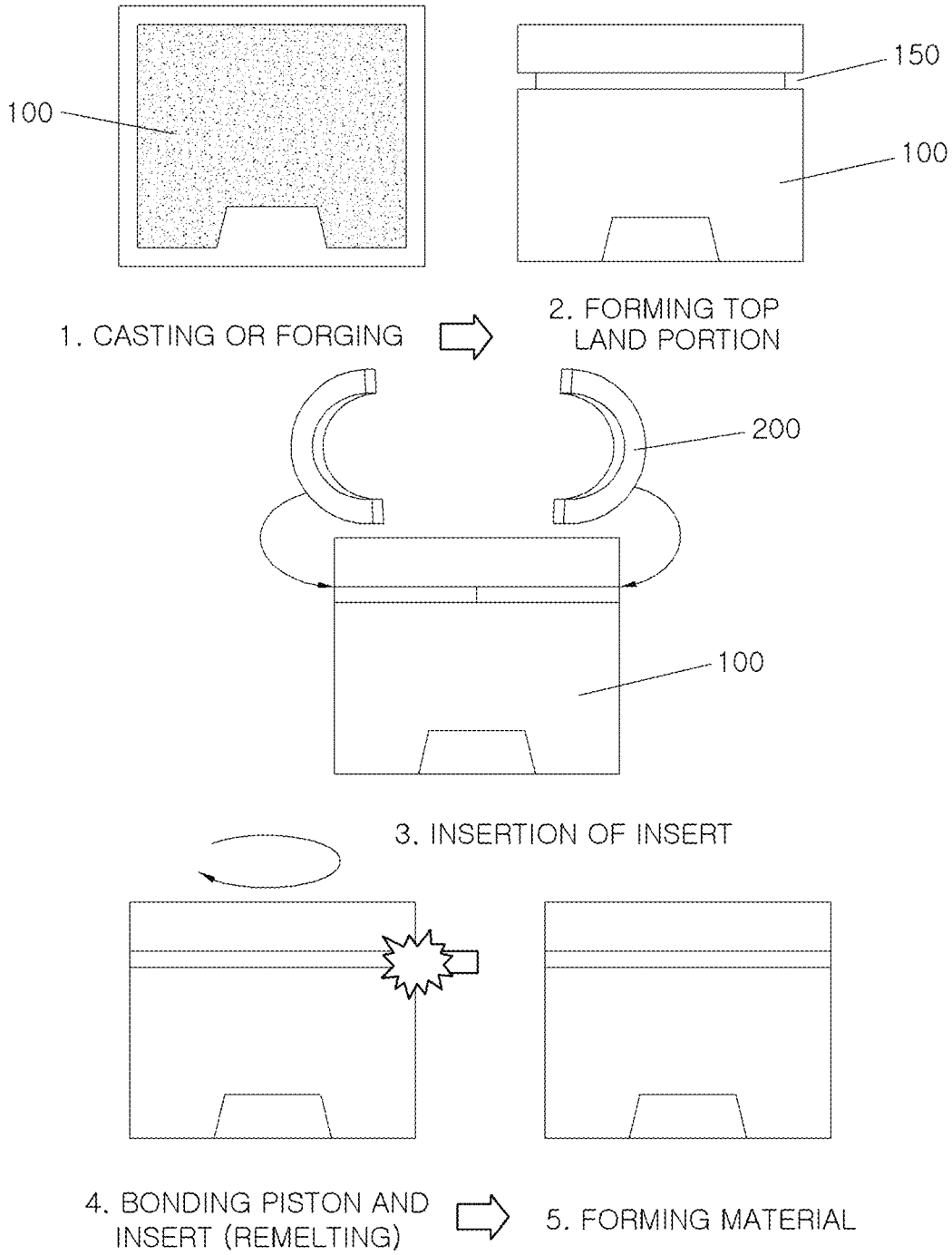
FIG. 5 is a view schematically illustrating a method of manufacturing a piston using an insert ring that is made of an aluminum alloy according to an embodiment of the present invention.
Figure 7:
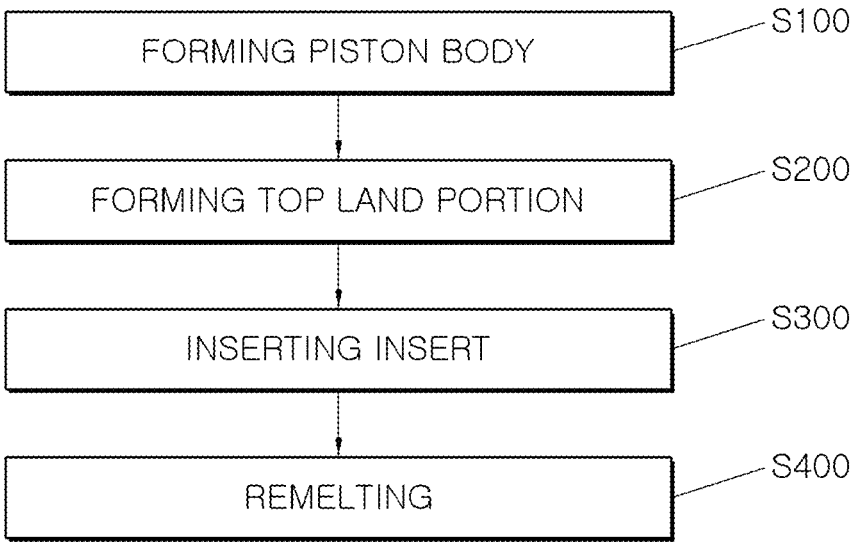
FIG. 7 is a flowchart illustrating the method of manufacturing a piston using the insert ring that is made of an aluminum alloy according to the embodiment of the present invention.

FIG. 5 is a view schematically illustrating a method of manufacturing a piston using an insert ring that is made of an aluminum alloy according to an embodiment of the present invention, and FIG. 7 is a flowchart of the method.

Referring to FIG. 5, the method of manufacturing an engine piston using the insert ring that is made of an aluminum alloy, may include a step of forming a piston body (S100), a step of forming a groove for insertion of the insert ring along the outer circumference of the body (S200), a step of inserting each of two or more ring pieces into the groove such that the insert ring is formed by coupling the ring pieces to each other (S300), and a step of remelting the groove into which each of the ring pieces is inserted (S400), unlike a conventional method of using an insert ring made of cast iron.

In this case, the insert ring may be made of the aluminum alloy that has the above composition and microstructure. That is, the aluminum alloy according to the embodiment of the present invention may be composed of Al as a base material, 24 to 30 wt % of Cu, and 0.3 to 4.1 wt % of Si, may include a lamellar microstructure that comprises an Al phase and a phase of $Al_2Cu$, which is an intermetallic compound, on the microstructure thereof, and may further include a Si phase formed on the microstructure thereof. However, as described above, the ratio between a phase fraction of Al and a phase fraction of $Al_2Cu$ is preferably limited to from 0.78 to 1.23 in order to generate the lamellar microstructure on the microstructure of the aluminum alloy.

In addition, as described above, the content of Si is preferably from 0.3 to 4.1 wt % in order to generate the Si phase on the microstructure of the aluminum alloy in the present invention.

The re-melting step is preferably performed at a temperature of 525° C. to 600° C., with the consequence that it is possible to prevent hot cracks from occurring due to an increase in temperature while the re-melting step is performed at a temperature that is equal to or higher than the minimum temperature for melting an Al—Cu-based alloy. In addition, the re-melting step is preferably performed within 3 minutes. The reason is because blow holes may be generated and the base material of the piston may be damaged due to heat as the re-melting time is increased. In addition, a shielding gas such as nitrogen, argon, or helium may be selectively used for the method.

In accordance with the method of manufacturing an engine piston according to the embodiment of the present invention, it is unnecessary to treat the surface of the insert ring in advance through a conventional AlFin process.

Moreover, since the piston body is previously formed and then the insert ring is inserted thereinto, it is possible to manufacture the engine piston even through a forging process, unlike the conventional method of using an insert ring made of cast iron.

Figure 2:
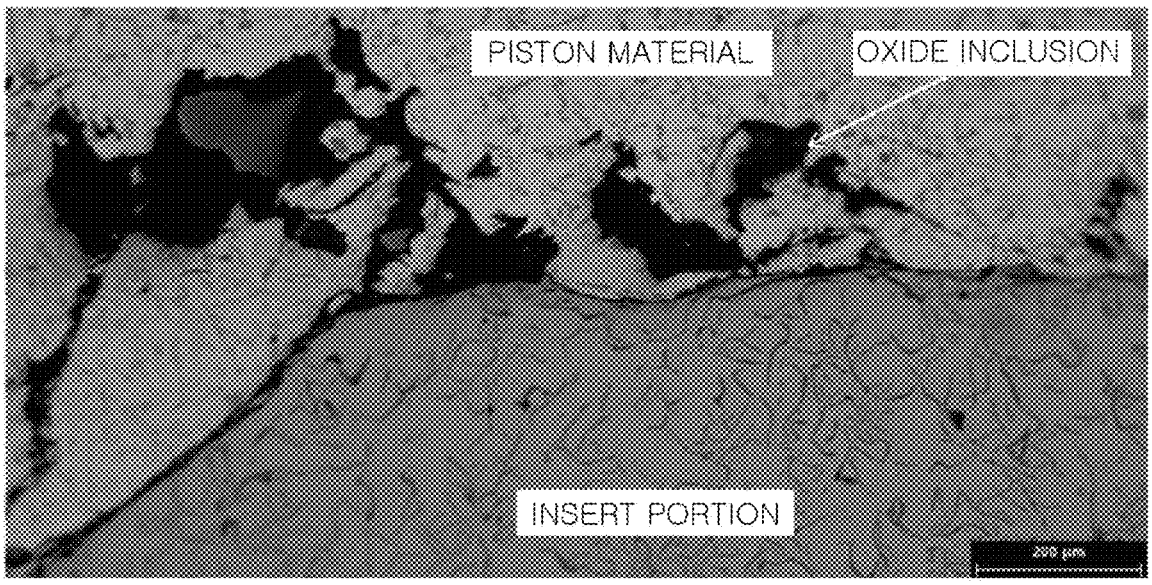
FIG. 2 is a structure photograph illustrating an insert ring bonding portion of a piston that is manufactured by the method of FIG. 1.
Figure 6:
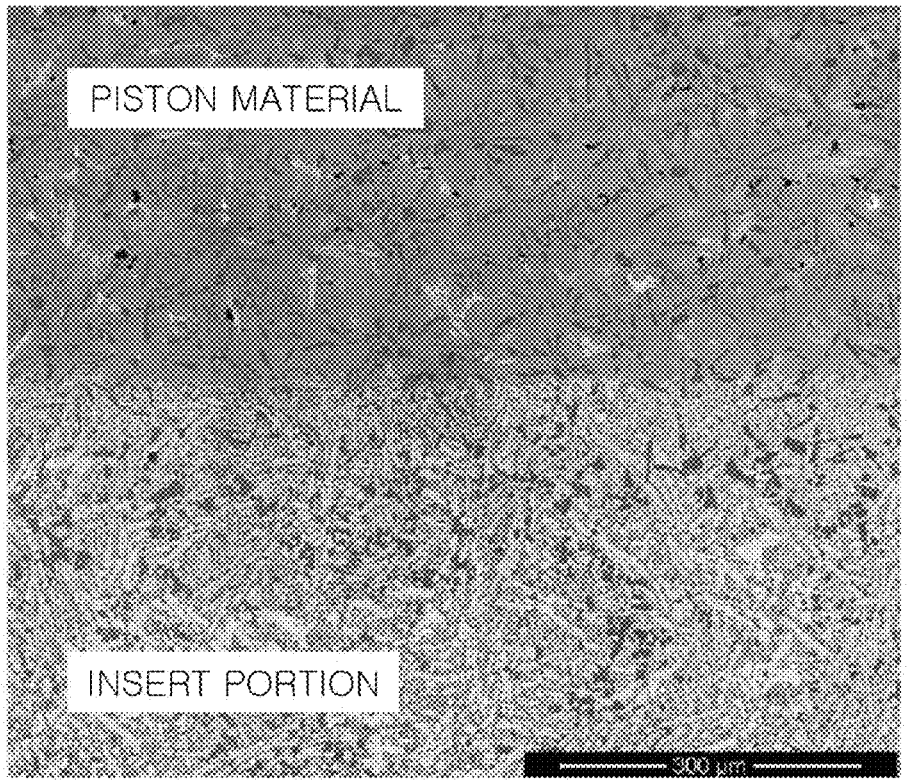
FIG. 6 is a structure photograph illustrating an insert ring bonding portion of a piston that is manufactured by the method of FIG. 5.

FIG. 2 is a structure photograph illustrating an insert ring bonding portion of a piston that is manufactured by the conventional method of FIG. 1. FIG. 6 is a structure photograph illustrating an insert ring bonding portion of a piston that is manufactured using an insert ring that is made of an aluminum alloy according to the embodiment of the present invention.

As seen in FIG. 2, poor bonding may occur on the interface between aluminum as a piston base material and an insert ring made of cast iron due to inclusion of oxide since the dissimilar materials are bonded to each other in the conventional method. However, it can be seen that bonding properties are improved through the re-melting process since the similar materials are bonded to each other in the present invention, as seen in FIG. 6.

The present invention can provide a lightweight Al—Cu—Si-based aluminum alloy having high strength and abrasion resistance, and an insert ring using the same.

In addition, the present invention can provide a piston manufacturing method capable of improving bonding properties of interfaces between the insert ring and aluminum as a base material of a piston by applying the insert ring thereto.

Although embodiments have been described with reference to a number of illustrative embodiments thereof, it should be understood that numerous other modifications and applications may be devised by those skilled in the art that will fall within the intrinsic aspects of the embodiments. More particularly, various variations and modifications are possible in concrete constituent elements of the embodiments. In addition, it is to be understood that differences relevant to the variations and modifications fall within the spirit and scope of the present disclosure defined in the appended claims.

What is claimed is:

1. An aluminum alloy for an insert ring, comprising:

Al as a base material;

wherein the aluminum alloy comprises a lamellar microstructure comprising Al and $Al_2Cu$ on its structure and a microstructure comprising a Si phase on its structure;

wherein a ratio between a phase fraction of Al and a phase fraction of $Al_2Cu$ is from 0.78 to 1.23; and wherein the aluminum alloy has strength of 201 MPa or greater.

2. The aluminum alloy of claim 1, wherein the aluminum alloy comprises 24 to 30 wt % of Cu and 0.3 to 4.1 wt % of Si.

3. An insert ring for an engine piston, manufactured through a casting process using an aluminum alloy that comprises Al as a base material;

wherein the aluminum alloy comprises a lamellar microstructure comprising Al and $Al_2Cu$ on its structure and a microstructure comprising a Si phase on its structure;

wherein the aluminum alloy comprises a lamellar microstructure comprising Al and $Al_2Cu$ on its structure and a microstructure comprising a Si phase on its structure; and wherein the aluminum alloy has strength of 201 MPa or greater.

4. The insert ring of claim 3, wherein the insert ring is formed by coupling two or more separated ring pieces to each other.

5. The insert ring of claim 3, wherein the aluminum alloy comprises 24 to 30 wt % of Cu and 0.3 to 4.1 wt % of Si.

6. The insert ring of claim 5, wherein a ratio between a phase fraction of Al and a phase fraction of $Al_2Cu$ on its structure is from 0.78 to 1.23.

7. The insert ring of claim 3, wherein a ratio between a phase fraction of Al and a phase fraction of $Al_2Cu$ on its structure is from 0.78 to 1.23.

8. A method of manufacturing an engine piston into which an insert ring is inserted in order to reinforce a top land portion, the method comprising:

forming a piston body;

forming a groove for insertion of the insert ring along an outer circumference of the piston body;

inserting a plurality of ring pieces into the groove such that the insert ring is formed by coupling the ring pieces to each other; and re-melting the groove into which each of the ring pieces is inserted;

wherein each of the ring pieces has Al as a base material;

wherein an aluminum alloy of each of the ring pieces comprises a lamellar microstructure comprising Al and $Al_2Cu$ on its structure and a microstructure comprising a Si phase on its structure;

wherein, for the aluminum alloy, a ratio between a phase fraction of Al and a phase fraction of $Al_2Cu$ is from 0.78 to 1.23; and wherein the aluminum alloy has strength of 201 MPa or greater.

9. The method of claim 8, wherein each of the ring pieces p the aluminum alloy comprises Al as the base material, 24 to 30 wt % of Cu, and 0.3 to 4.1 wt % of Si.

10. The method of claim 9, wherein each of the ring pieces is manufactured through a casting process.

11. The method of claim 8, wherein forming the piston body comprises forming the piston body through a casting process.

12. The method of claim 8, wherein forming the piston body comprises forming the piston body through a forging process.

13. The method of claim 8, wherein the insert ring reinforces a top land portion of the piston body.

14. An engine piston manufactured according to the method of claim 8.

* * * * *